United States Patent [19]

Lower et al.

[11] Patent Number: 4,802,591

[45] Date of Patent: Feb. 7, 1989

[54] LOUVERED CHIP SCREENER

[75] Inventors: William E. Lower; W. Nash McCauley, both of Cincinnati; Stephen C. Mitchell, Westchester; Roger C. Robins, Reading; Steven A. Schmidt, Cincinnati, all of Ohio

[73] Assignee: Rotex, Inc., Cincinnati, Ohio

[21] Appl. No.: 167,690

[22] Filed: Mar. 14, 1988

Related U.S. Application Data

[63] Continuation-in-part of Ser. No. 901,885, Aug. 29, 1986, abandoned.

[51] Int. Cl.[4] ..... B07B 13/04; B07B 1/28

[52] U.S. Cl. ..... 209/680; 209/323; 209/395

[58] Field of Search ..... 209/310, 405, 675, 319, 209/323, 382, 379, 393, 395, 674, 680

[56] References Cited

U.S. PATENT DOCUMENTS

| | | | |
|---|---|---|---|
| 24,155 | 5/1859 | Snell et al. | 209/677 |
| 382,215 | 5/1888 | Coxe et al. | 209/677 |
| 434,247 | 8/1890 | Closz . | |
| 450,482 | 4/1891 | Coxe | 209/674 X |
| 454,393 | 6/1891 | Bartl et al. . | |
| 488,211 | 12/1892 | Long | 209/393 |
| 706,061 | 8/1902 | Huber | 209/397 |
| 807,355 | 12/1905 | Campbell . | |
| 936,015 | 10/1909 | Mowery | 209/677 |
| 1,321,510 | 11/1919 | Dodds | 209/397 |
| 1,363,818 | 12/1920 | Scott . | |
| 1,562,311 | 11/1925 | Dimm | 209/382 |
| 2,114,406 | 4/1938 | Simpson . | |
| 2,311,813 | 2/1943 | Beck et al. . | |
| 2,827,169 | 3/1958 | Cusi . | |
| 2,829,772 | 2/1956 | Landes et al. | 209/323 |
| 2,911,097 | 11/1959 | Rose . | |
| 2,954,124 | 9/1960 | Young . | |
| 3,455,445 | 7/1969 | Allen et al. . | |
| 3,565,251 | 2/1971 | Pennington | 209/323 |
| 3,819,050 | 6/1974 | Lower . | |
| 4,234,416 | 11/1980 | Lower et al. . | |
| 4,351,719 | 9/1982 | Morey . | |
| 4,376,042 | 3/1983 | Brown . | |
| 4,504,386 | 3/1985 | Dyren et al. . | |

FOREIGN PATENT DOCUMENTS

| | | | |
|---|---|---|---|
| 748383 | 7/1933 | France | 209/397 |
| 3326 | 9/1912 | United Kingdom | 209/397 |
| 814542 | 6/1959 | United Kingdom | 209/674 |

OTHER PUBLICATIONS

J. V. Hatton, "Chip Quality Evaluation", *Pulp & Paper Canada,* vol. 77, No. 6, pp. 61–68, Jun. 1976.

*Primary Examiner*—Johnny D. Cherry
*Assistant Examiner*—Gary C. Hoge
*Attorney, Agent, or Firm*—Wood, Herron & Evans

[57] ABSTRACT

A machine and method for separating chip-like particles according to thickness which provides low blinding and high efficiency at high throughput in sustained operation. The machine has a sloping deck mounting a series of spaced flexible louvers or slats which extend parallel to the direction of chip flow down the deck. The slats are canted transversely to the direction of flow, and present unobstructed full length slot-like chip openings between them. The deck is driven with a horizontal gyratory motion such that during the upstream half of each cycle of movement, each slot moves toward chips on the adjacent slat which slopes toward it, and moves away from such chips during the downstream half of the cycle. The path of screening movement is uniform over the entire deck, that is, the motion of the lower or discharge end of the deck matches that of the upper or feed end. Adjacent slats are supported at alternate or staggered positions along their length so that they can deflect slightly relative to one other along their entire length. Ball cleaners are directed to impact on the slats in the transverse direction to deflect them and thereby dislodge chips stuck between the slats.

29 Claims, 5 Drawing Sheets

LOUVERED CHIP SCREENER

This is a continuation-in-part of co-pending application Ser. No. 06/901,885, now abandoned, filed Aug. 29, 1986, titled "Chip Screener With Slots Parallel To Direction Of Flow."

FIELD OF THE INVENTION

This invention relates to screening and classifying machines, and more particularly to a machine and method for separating flat or plate-like chips such as woodchips, according to their thickness.

BACKGROUND

A typical screening machine has a deck or screen with openings which are sized to pass particles having a maximum dimension smaller than the openings. Although such decks are widely used for making separations according to size, they are relatively inefficient for separating chips such as woodchips wherein the critical dimension is the thickness of the chip rather than the dimensions of its face. For example, woodchips of the type used in the manufacture of pulp are cut in roughly plate-like form, approximately square to elongated rectangular, having facial dimensions which are several times chip thickness. At the present time the optimal or desired dimensions are approximately ½ to 1½ inches in length and width, and about ⅜ inch (about 8 millimeters) in thickness. The importance of thickness as the critical dimension arises from the fact that thickness, rather than length or width, limits the penetration of digesting chemicals into the center of the chip.

Chips as they come from commercial chipmaking processes comprise an almost continuous spectrum of sizes and thicknesses. "Accepts," that is, chips which are within the proper thickness range, must be separated from "fines," which are below the desired size range, and also from "overthicks" or "overs" which have a thickness greater than a predetermined maximum limit for the particular digestion process. (While there is sometimes a very rough correlation between chip facial dimensions and chip thickness, a separation according to length or width does not generally provide an acceptable separation according to thickness.) Conventional decks are quite efficient in removing fines, but they are much less efficient in making accurate separations of overs according to thickness and without regard to length and width. This is because conventional decks tend to pass chips according to surface length and width rather than thickness, which is typically less than length and/or width. The problem of separating chips according to thickness is much more difficult than that of separating chips according to facial dimension, especially where the chips are coarse in thickness and tend to be tapered. Screen blinding becomes a severe problem; and no matter how efficient, a screen which blinds in a short period of time is impractical for large scale commercial use, because of frequent shut-down required to clear chips lodged in the deck openings.

PRIOR ART

Snell et al U.S. Pat. No. 24,155 shows a stationary screen for separating slate from coal, wherein downward slanting, laterally tilted slats are supported on ratchet-like cross bars that interrupt the slots. The device is stationery; there is no screen motion, and the screen would soon blind if used for sizing chips.

Coxe et al U.S. Pat. No. 382,215 shows a slate picker in which a sloping chute of sawtooth-shaped cross section presents short tapered longitudinal openings which increase in width toward the lower end and which do not extend to the top of the chute. The device is stationary, and would be inefficient for thickness sizing.

Bartl et al U.S. Pat. No. 454,393 shows a slate picker wherein inverted angle irons are supported in parallel on narrow posts projecting from cross bars; the slots between the angle irons are positioned to feed onto longitudinal rods directly below them to direct the particles to one side or the other.

Simpson U.S. Pat. No. 2,114,406 shows a sloping deck screener with a caged ball cleaner. The deck is gyrated at its upper end but moves nearly linearly at its lower end.

Rose U.S. Pat. No. 2,911,097 shows a deck comprising parallel rods mounted on supports which are staggered to permit the rods to flex so as to clear stuck particles. The rods are not canted transversely, and tend to orient particles on edge vertically to enter the slots between the rods. No screening motion is described; a horizontal motion would be transverse to such chip orientation.

In Young U.S. Pat. No. 2,954,124, spaced, parallel inclined slots form a separating unit having both a longitudinal slope and a lateral slope. The slats overlap, establishing throats between them which face up the lateral slope. The deck is vibrated in a vertical plane with an elliptical motion, that is, parallel to the long axes of the slots. This causes round oversize pieces to roll downward laterally across the slats and longitudinally along the slots, whereas thin flat pieces slide longitudinally along the slats and accepts pass between them.

Lower et al U.S. Pat. No. 4,234,416 shows a screener having a conventional screen driven in a generally circular screening motion, multiple screen decks, and caged ball cleaners for each deck. The machine is inefficient for thickness sizing of chips.

Morey U.S. Pat. No. 4,351,719 shows a woodchip screener having openings which are crosswise to the direction of flow, rather than longitudinal.

Dryen et al U.S. Pat. No. 4,504,386 shows a wood chip separator having two decks, one comprising fixed parallel rods, the other a movable grid of rods positioned between the rods of the first deck. The movable grid is reciprocated to toss chips upwardly and longitudinally while maintaining the gaps between the rods.

THE PROBLEM IN THE INDUSTRY

At present, so called disk separators are most commonly used for separating wood chips according to thickness. These comprise a plurality of disks mounted on parallel rotating shafts. The disks on one shaft mesh with the disks of adjacent shafts to form screening gaps between them. The effective screen area is relatively small in relation to the size of the machine, and large numbers of disks and shafts are required for substantial production capacity. Moreover, as stated in Dryden U.S. Pat. No. 4,504,386 previously referred to, and manufacturing costs are relatively high; and resin deposits, contra-rotation of the disks, and friction require high power input, increase wear, and require unduly high maintenance. In practice disk separators often require an initial coarse unloading step and/or a fines removal to be carried out on a gyratory screener, see for example Brown U.S. Pat. No. 4,376,042. This further increases the cost and size requirements of a disk screener system.

Indeed, the difficulties of making a thickness separation of wood chips in a sample comprising an overthick fraction, accepts, and an undersize fraction has led to the conclusion that such evaluation could be achieved only by a combination slot screen and round hole screen classifier, see J.V. Hatton, "Chip Quality Evaluation," *Pulp & Paper Canada,* Vol. 77, No. 6, pages 61-68, June, 1976. Nevertheless, the ineffectiveness of chip screeners for thickness sizing is so severe that disk screeners have virtually completely obsoleted them in the marketplace for this purpose, despite their advantages of lower cost, smaller size and ease of maintenance. Essentially all commercial chip thickness sizing systems being installed today are of the disk screeners type.

Because of the difficulties mentioned above with disk screeners, and the further expense if a disk screener is combined with a gyratory screen as suggested by Brown, there is a serious need for a less costly machine and method for sizing chips according to thickness, having a high throughput and an ability to efficiently separate a large mass of chips per unit time, yet which does not blind or become clogged with oversized chips in sustained operation.

Many attempts were made by the present inventors to solve the blinding problem, without also impairing screening efficiency. It was attempted to use an inclined deck having transverse sawtooth-like corrugations (running crosswise to the direction of chip flow), which present slot-like openings facing upstream (toward the direction from which the chips are coming). It was found that this efficiently separated chips thinner than the slot width, but the slots were very prone to blinding or clogging by oversize or wedge-shaped chips which become lodged in the slots so as to block them. Even if a ball cleaner was provided, the deck required frequent machine shut-down to clear the chips from the slots to reopen them for efficient operation.

It was also attempted to separate woodchips by orienting such a deck reversely, that is, with the slots facing downstream. This provided good freedom from blinding, but it did not provide such good separation of the accepts; an undesirably high proportion of accepts slid over the slots, remained on the deck and became part of the overs.

More recently, as described in parent application Ser. No. 06/901,885, now abandoned, of which this is a continuation-in-part, it has been found that a machine of the general type shown in Simpson U.S. Pat. No. 2,114,406, but fitted with an experimental longitudinally louvered deck and a ball cleaner, provided an excellent screening action in tests of a few minutes duration. However, it was later found that over a prolonged period of continuous use (e.g. twenty minutes) the screen was gradually blinded to an unacceptable degree—that is, chips became jammed in the slots—and throughput eventually diminished seriously because a large proportion of the slots were effectively closed and rendered useless. What was still needed, therefore, was a machine which had high throughput but which did not blind in continuous operation.

In general, until this invention was made, all our attempts to achieve the desired result were unsuccessful: blinding was a constant problem, and could be solved only at a great loss of efficiency.

BRIEF SUMMARY OF THE INVENTION

In accordance with this invention, a chip-thickness sizing machine is provided which has an inclined deck comprised of spaced apart, flexible parallel slats (sometimes called "louvers") which extend an upper feed end to a lower discharge end. Continuous uninterrupted slot openings are presented between the slats and extend from the upper end to and through the lower end of the deck, parallel to the "longitudinal" direction of chip flow. (As used herein, the term "longitudinal" means the overall direction of chip flow from the feed end of the deck to the lower or discharge end, regardless of actual dimensions of the deck. The term "chip" means a particle having face dimensions substantially greater than its thickness, such as woodchips, flakes, parquet floor slats, pillow-shaped cereals and the like.) Each slat is slightly tilted or canted in the transverse direction, that is, crosswise to the direction of flow. The edges of the slats should not vertically overlap.

We have found that a particular type of screening motion provides superior results. Specifically, the deck should be gyrated in a generally horizontal plane, with a circular motion so directed that during the "upstream half" of the rotary cycle (i.e., that half of the path of motion which lies closer to the upper end), a point on a slot is moving relatively transversely toward a chip on an adjacent slat which faces that slot; and away from such chip on the "downstream half" of the cycle. This screening movement can of itself provide a marked improvement in separation in a given period, in comparison to the results obtained with other types and directions of motion (vertical, linear longitudinal, linear transverse, etc.). Even the reverse direction of rotation, in the same plane, gives substantially poorer results. We are unable to explain this odd phenomenon. The motion should preferably be of relatively low frequency and high amplitude. It should be uniform across the entire deck area, and not, for example, like the motion of machines of the type shown in U.S. Pat. Nos. 2,114,406, or 3,443,357, in which the feed end of the deck moves in an orbital path but the discharge end moves back and forth nearly linearly. To achieve this motion the screen frame may be suspended on rods or cables, with the drive mounted on the frame and moving with it.

It has further been found that each slat should be supported at positions along its length which are staggered with respect to the supports of the slats on either side of it. This enables each slat to vibrate or deflect slightly along its length so that the width of the slot between two adjacent slats is not rigidly constrained at any point. Further, the effect of such slat flexibility has been found to be greatly enhanced by the use of a caged ball cleaner beneath the slats, having narrow elongated ball supports. Preferably, the supports are rods formed with upstanding peaks along their length; surprisingly, this greatly improves the cleaning action. The formed supports tend to direct the cleaning balls to bounce more transversely against the slats, so as to impact on them in a direction that causes the slats to flex or vibrate. Under this cleaning action, near accepts or wedge-shaped chips which become stuck in a slot are released due to vibration or elastic movement of the slats relative to one another. In effect, the width of the slot is momentarily increased by elastic flexing of the slat in response to impact of a ball cleaner. Each slot extends without interruption essentially the full length of the deck, from the top end to and through the discharge end of the deck. Slat supports which block or rigidly control the width of the slots have been found to impede movement of overs along the slots and to act as dams against which chips in the slots pile up, become lodged, and thereby reduce capacity. Overthick chips which otherwise would tend to blind the slots are "washed" or "swept" longitudinally out of the slots in which they tend to jam, and they are carried along to the overthick collector.

Surprisingly, we have now found that a machine of the type described provides better screening results, in continuous operation, than any other type of device known to us. Throughput is increased and blinding stabilizes at a level acceptable for continuous operation. The type of motion, the slat configuration, and the ball cleaners each contribute to providing better results for chip thickness sizing. Thus, in comparison to the motion of a conventional "Rotex" machine, the motion described herein greatly reduces the blinding that would tend to occur at the lower end of the deck under the partly gyratory, partly linear motion of a "Rotex" machine, and thereby provides better throughput for a given deck area.

In screening, the chips tend to lie facially on the planar upper faces of the slats, and are caused to slide edgewise toward the slots. The screening motion described tends to "drive" the thinner chips through the slots on the upstream half of the cycle, by moving the openings toward them as they slide transversely and downwardly.

We have evaluated the effects of various deck constructions, screening motions, and ball cleaners. As shown hereinafter, the separating efficiency for a screening machine in accordance with this invention is much better than for other types of machines, and the machine blinds less in prolonged operation.

DESCRIPTION OF THE DRAWINGS

The invention can best be further described by reference to the accompanying drawings, in which.

DETAILED DESCRIPTION

The invention can be utilized in various types of screening machines, including single deck machines as well as multiple deck machines. For purposes of explanation, a single deck embodying the principles of the invention is first described, with reference to FIGS. 1 and 2; a multiple deck machine is then described with reference to FIGS. 3–6.

Figures 1, 2:
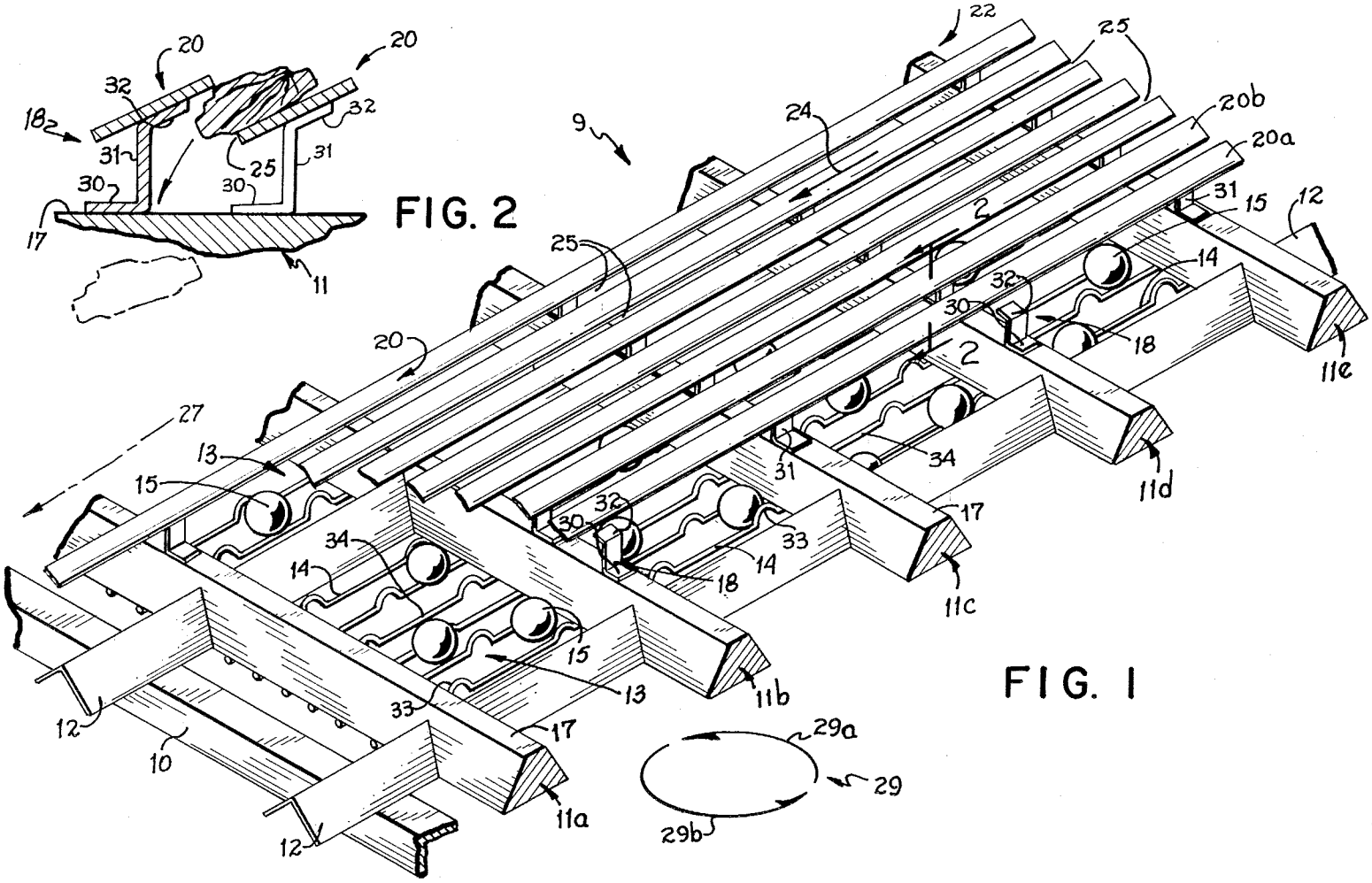
FIG. 1 is a fragmentary perspective view, of a deck in accordance with a preferred embodiment of the invention.
FIG. 2 is an enlarged diagrammatic view, taken on line 2—2 of FIG. 1, through a pair of adjacent slats, with a chip between them.
Figure 3:
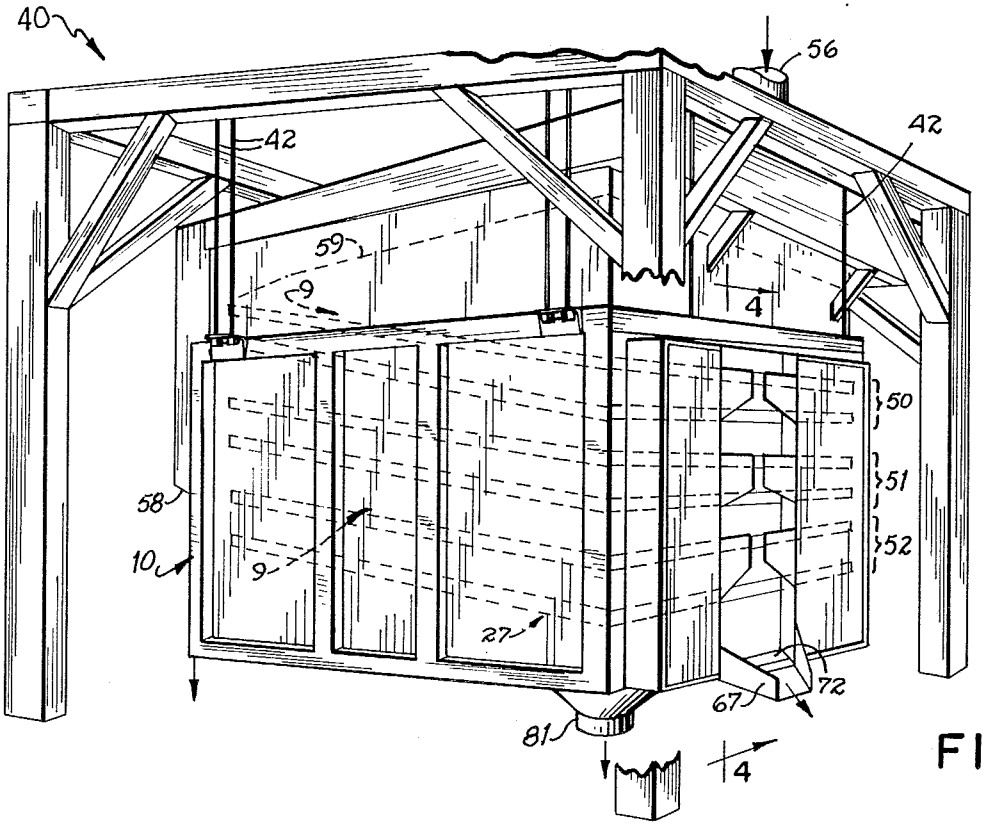
FIG. 3 is a perspective, partly broken away, of a preferred form of multideck machine in accordance with the invention.

Referring to FIG. 1, a deck 9 in accordance with the invention is mounted and supported by a peripheral frame 10 which, in the embodiment shown, mounts an open gridwork of cross-members 11 and longitudinal members 12. Both the cross members 11 and the longitudinal members 12 have angulated walls (see FIG. 1), and intersect to define a plurality of generally rectangular ball cleaner cages 13. Spaced, parallel, ball support rods 14 extend longitudinally below members 11 and 12, and support and confine a plurality of resilient balls 15 in the respective cages 13. Each ball support rod 14 has a series of "bumps" or peaks 33 along its length, defined by vertically oriented upwardly projecting U-bends in the rod, and separated by horizontal valleys 34 between them. Each rod presents two or more peaks in each cage; and it will be noted that the peaks of adjacent rods in the same cage are staggered or misaligned with one another. The balls 15 may be of a type known per se, and are larger than the spacing between the rods 14 and the slots between the louvers 20 of the deck 9, to be described.

The deck 9 comprises a series of parallel, spaced apart longitudinal slats or louvers 20 in the form of elongated flat bars which establish slot-like openings 25 between them. Each slat 20 and each slot 25 extends uninterruptedly for the entire length of the deck; endwise gaps between slats, abutments, or other interruptions in the slots or slats would tend to act as barriers or stops which could arrest the flow of chips down the slats and thereby cause blinding.

The deck is inclined in the longitudinal direction, sloping downwardly from an upper or feed end 22 (the right end in FIG. 1) to a lower or discharge end 27. The chip material to be screened is deposited onto upper end 22, and slides and is conveyed downwardly by the screening motion (to be described) in the longitudinal direction of the slats 20, i.e., in the general direction of arrow 24, toward deck lower end 27. In general the steeper the angle of deck inclination, the less the blinding but the lower the separating efficiency. For wood-chip screening, the angle of deck inclination is usually about 6°–10°. The optimum angle for a given machine and material is readily determined by comparative tests.

As seen in FIG. 1, each slat 20 is canted or tilted transversely with respect to the overall plane of deck 9; that is, each slat forms an acute angle in crosswise direction, i.e., perpendicular to arrow 24, with the plane of the deck. The slats are spaced apart sufficiently that the upper edge of one slat does not vertically overlie the lower edge of an adjacent slat. The width of the slot between adjacent slats, as measured between the upper edge of one slat and the lower edge of an adjacent slat, defines the nominal upper limit of the thickness of the chips which will pass through (see FIG. 2).

Each slat is mounted on slat supporting struts or posts 18, which project upwardly from the upper surface 17 of cross members 11. In the preferred embodiment each post 18 has a base 30 which is secured to cross member 11; an upstanding leg 31, and an angulated arm 32 which engages and is secured beneath the slat 20. The angulation of arm 32 determines the tilt angle of the slats, and may for example be in the rang of about 15° to 30° to the plane of the deck. The width of posts 18 and arms 31 is less than the width of the slats 20; the posts must not project into the slots. Post height is sufficient that chips sliding in the slots are not arrested by the crossbars.

The slats of adjacent pairs of slots are supported at staggered or different positions along their length. This is preferably accomplished by mounting adjacent slats 20 on posts 18 on alternate or different cross members 11. With reference to FIG. 1, it can be seen that each slat 20 is supported by a post 18 on every other cross member 11, and moreover that alternate slats are supported at alternate cross members. Thus, slat 20*a* is supported on posts from cross members 11*a*, 11*c* and 11*e*, while the adjacent slat 20*b* is supported from cross members 11*b* and 11*d*, etc.

Each slat 20 provides limited flexibility in the vertical direction, between the posts 18 which support it. The staggered struts 18, together with the flexibility of the slats, permits relative deflection between each pair of slats along their entire length. The degree of flexion need only be sufficient to permit wedge-shaped chips (which tend to get stuck in the slots) either to pass through the slots or to be released sufficiently that they are swept on down the length of the deck by the flow of material and off the discharge end. The outside of the envelope of the relative movement of adjacent slats determines the maximum thickness of chips to be passed, and is in turn determined by slat dimensions, material, support spacing, and machine movement forces which act on it under load.

The deck should be driven by a drive which establishes a circular path of motion of the entire deck in a horizontal plane. The motion is indicated diagrammatically by the arrows 29 in FIG. 1. As noted, the relationship between the direction of rotation and the inclination of the slats is important. Specifically, as shown in FIG. 1, in the upstream half 29*a* of the cycle of rotation (i.e., that half of the path of movement of a given point which is closer to the upstream end 22 of the deck), the slot openings 25 should move in the direction generally toward chips on the slats 20 facing them; and during the downstream half of the cycle 29*b*, the slots should be moving away from chips on the adjacent slats.

Figure 4:
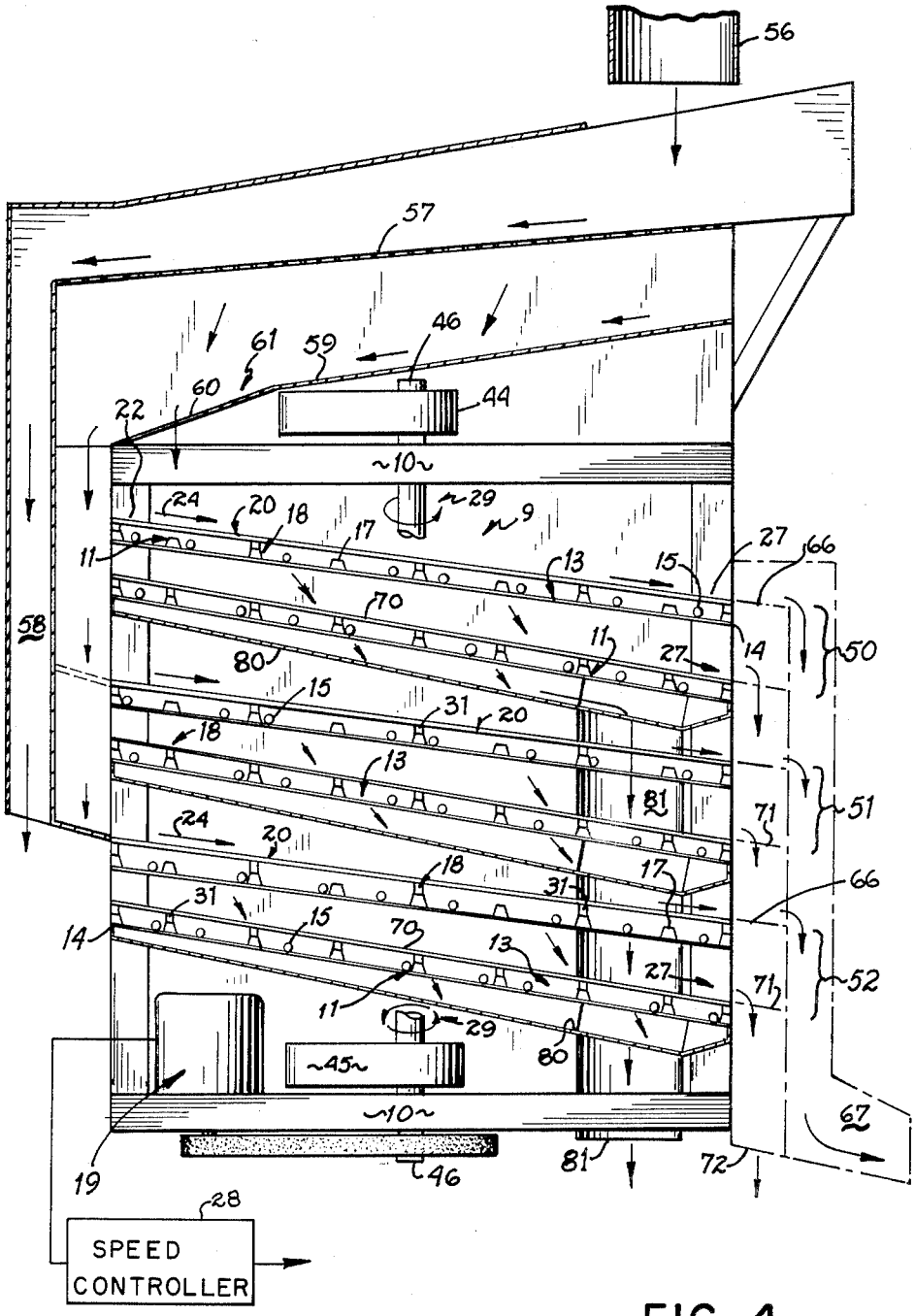
FIG. 4 is a vertical cross section taken on line 4—4 of FIG. 3, and diagrammatically shows the flow of various fractions through the machine.
Figure 5:
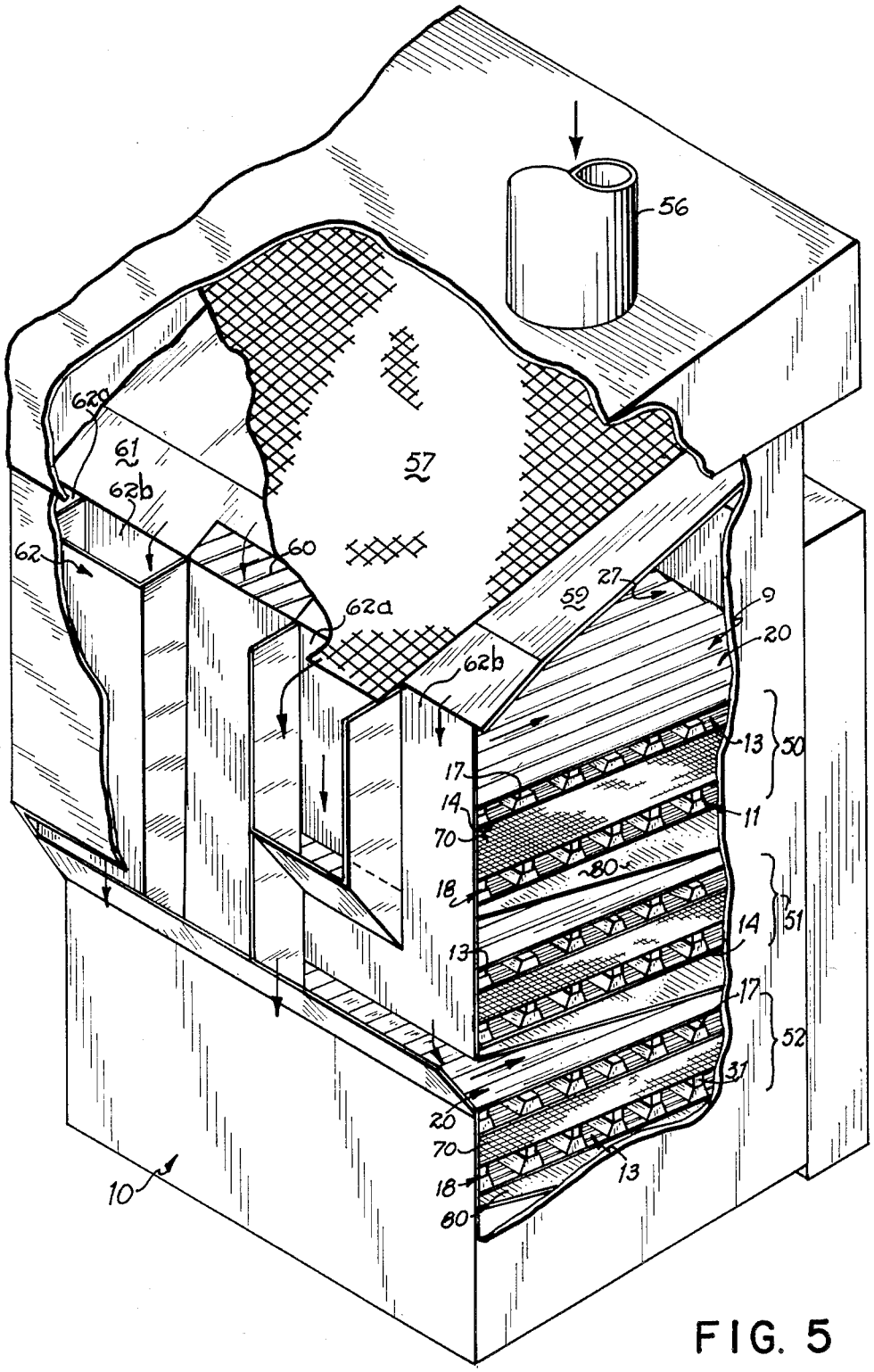
FIG. 5 is an enlarged fragmentary perspective of the machine of FIG. 3, partly broken away, showing the feed splitter by which the feed is divided into streams and is fed in parallel to the upper ends of the several decks.

A preferred drive which accomplishes this includes one or more rotating eccentrics such as are described in connection with FIG. 4. The drive shown there includes upper and lower eccentrics 44, 45, mounted on a vertical shaft 46 which is journaled for rotation in the deck frame. The drive is preferably mounted on and physically moves with the deck. The deck frame 10 should be suspended or supported so that the entire deck surface area follows the motion; both the upper and lower ends of the deck should move in the same manner.

In operation the motion chips on a given louver 20 tend to slide both longitudinally and transversely, that is, diagonally downwardly toward the adjacent slot. The chips tend to lie facially on the slats; if thinner than the slot width, the chips will fall through. The type and direction of rotation of the drive tends to expedite separation, although the reason for this is by no means clear. By way of example, in one test using woodchips, with the motion shown in FIG. 1, 29.6% of the chips was carried over the deck as overs, and 70.4% passed through as accepts. When the direction of rotation was reversed, all other factors remaining constant, 38.2% of the chips was rejected as overs and only 61.8% was accepted. In other words, approximately 23% (8.6/29.6) of accepts was improperly rejected when the motion of the invention was not used. This degree of improvement is extremely significant in terms of overall machine efficiency.

It is noted that the level of acceleration of the motion itself has some effect on blinding control. For example, in one set of tests, using gyratory speeds in the range of 214–265 rpm, cycle amplitudes in the range of $1\frac{7}{8}$ to $2\frac{1}{2}$ inches diameter, and a screen slope of six degrees, blinding increased significantly at acceleration levels less than 1.8 g. Acceleration levels may be adjusted for optimum separation in a given machine having the described characteristics, by varying cycle speed and amplitude.

It can be seen in FIG. 1 that the ball support rods 14 run in the longitudinal direction, parallel to the slats. The gyration of the machine causes the balls to bounce off the rods, especially off the peaks 33 within the cages, so that they impact against the slats. The peaks tend to direct the balls transversely against the slats, more than longitudinally; this apparently increases slat flexion and reduces blinding.

Tests have indicated that by itself, forming the rods with peaks as described substantially reduces the number of pieces which remain stuck between the rods at the end of a given run, other things remaining constant, in comparison to use of straight or unformed ball support rods. Similarly, comparison tests show that, with louvers which have supports at every cross-member and which are not alternated, blinding tends to be higher than for an otherwise similar deck having staggered supports on adjacent rods.

In the currently preferred embodiment of the deck for use in wood chip screening, the louvers are 0.75 inch wide, 0.13 inch thick, spaced to present nominal 8–10 mm wide slots, and lie at a 25 degree transverse angle to the deck. (Vibratory flexing of the slats between the posts causes the width of the slot between them to vary slightly from moment to moment in use. The opening at the midpoint between a pair of posts may vary up to ±0.5 mm. due to vibration and the impact of the cleaning balls.) The cage below each deck is approximately 12×15 inches in size. Using this deck, the machine ran for more than six days without requiring cleaning for blinding; in comparison, significant blinding occurred in other machines in less than one hour.

The preferred form of multi-deck screening machine shown in FIGS. 3–6 includes an overhead structure in the form of a trestle 40 for supporting the deck. Machine frame 10, which houses a plurality of decks 9, is suspended on cables or bars 42 from trestle 40 and can move relative to it.

The machine shown includes three screening sections 50, 51 and 52, each in accordance with the invention, which are fed in parallel. Each section includes a deck 9 with louvers of the type already described in connection with FIG. 1, and a ball cleaner mechanism 13 as previously described, beneath its deck 9 for impacting and flexing the louvers to clear stuck particles.

The chip material to be sized is delivered through a chute 56 at the top of trestle 40 from which it falls onto the upper end of a coarse or scalping screen 57. Screen 57 does not separate materials according to thickness, but rather simply removes grossly oversize chunks and distributes materials transversely across the width of the decks below. Oversize pieces remain on deck 57 and are conveyed to its lower end and fall into a scalp material outlet 58 for regrinding. The material which passes through the scalping screen 57 falls onto an inclined top cover 59 and, under the screening motion, is conveyed toward the lower end 61 of top cover 59, where it passes through a feed splitter, best shown in FIG. 5. The splitter divides the feed into three roughly equal streams which are directed onto three separate deck sections 50, 51 and 52 below.

The general structure of the feed splitter may be as described in Lower U.S. Pat. No. 4,234,416, the disclosure of which is incorporated by reference herein. Briefly, the feed splitter comprises one or more openings 60 in top cover 59 through which about ⅓ of the stream falls onto the top deck 50. Offset laterally from opening 60 are two series of parallel vertical channels 62 extending downwardly from the lower end 61 of top cover 59, and which are arranged to feed the louvered decks of the lower two screening sections 51 and 52. In the embodiment shown, one or more openings 60 feeds the deck 9 of the upper screen section 50; channels 62*a* and 62*b* feed the deck of lower screen sections 51 and 52 respectively.

Figure 6:
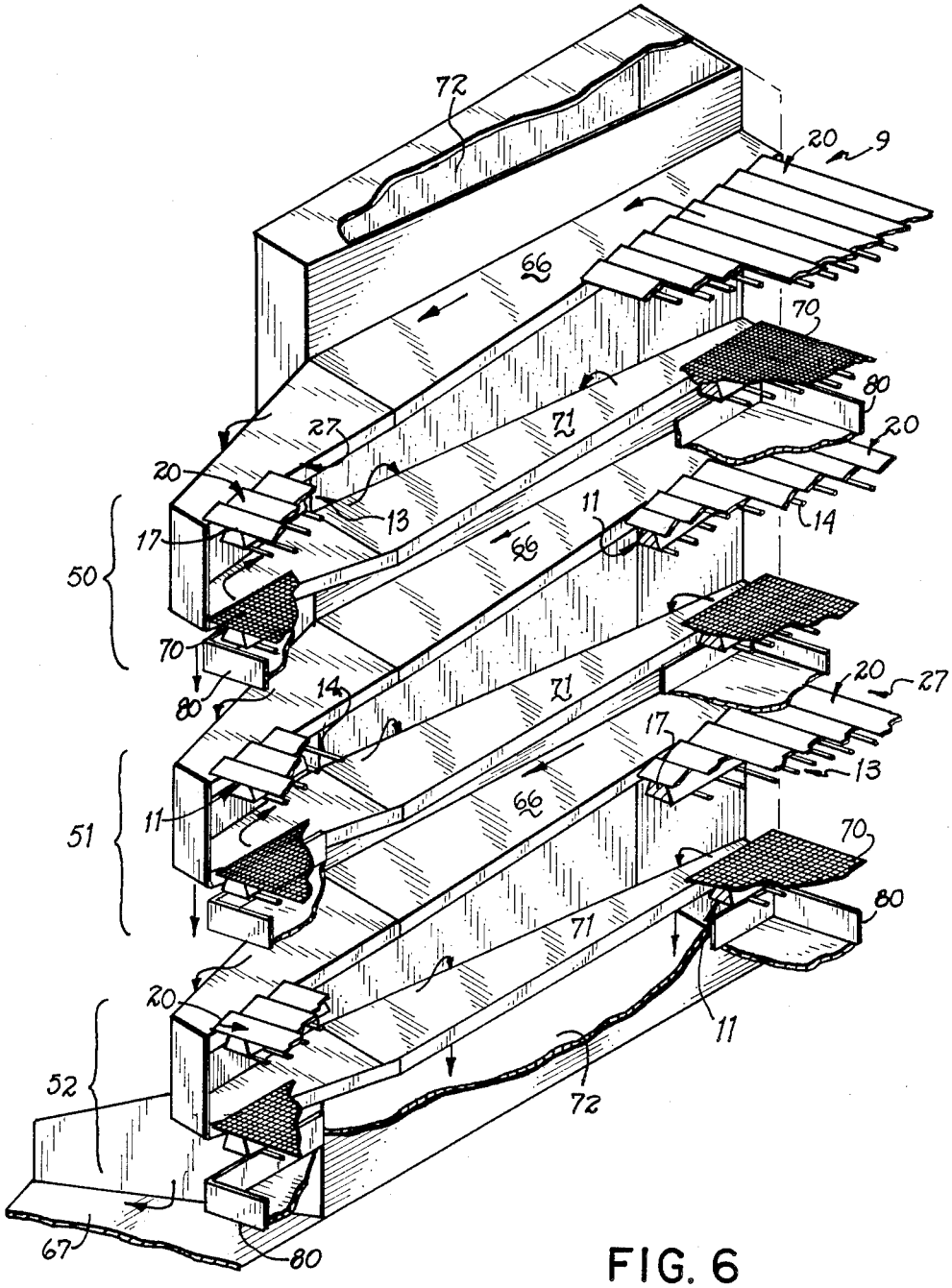
FIG. 6 is an enlarged fragmentary perspective through the stack of decks of the machine of FIG. 3, and illustrates the means by which the various size fractions are removed from the respective decks.

Referring now to FIG. 6, overs from the deck 9 of each section (50, 51 or 52) drop off the lower end of the deck onto an overs ramp 66 which leads transversely to an overs chute 67. Accepts fall through the louvers 20 and between the rods 14 of the ball cage 13, onto a fines removal screen 70 of the respective section. The lower end of the fines screen discharges accept chips onto an accepts ramp 71, then into an accepts chute 72. Screen 70 is sized to separate the very small pin-shaped particles (below the minimum accept range), which pass through a fines screen, into a fines collection pan 80 (FIGS. 4 and 6) and then into a fines collection chute 81.

It is further preferred that drive motor 19 be controlled by a speed controller 28, which cyclically varies its speed, so that the motor operates at a predetermined normal rate for a predetermined interval, then at a higher rate for a shorter interval. (Automatic speed controllers suitable for such use are available commercially.) For example, the normal drive speed may be 200 rpm for 15 minutes; the speed is then automatically increased about 5–25%, e.g. to 225 rpm, for one minute, and so on repeatedly. These bursts of speed appear to increase the ball action and to further reduce blinding. Increasing speed reduces slot separating efficiency, but by increasing speed only for brief intervals, blinding is reduced significantly without commensurate affect on cleaning efficiency.

Having described the invention, what is claimed is:

1. A machine for separating chips according to thickness, comprising, a frame mounting a sloping deck on which chips flow generally downwardly from an upper end toward a discharge end, the deck comprising a series of spaced parallel slats mounted on slat support means which are spaced apart along the length of the slats, the slats extending parallel to the downward direction of chip flow, the support means canting each slat transversely to the general plane of the deck, the slats presenting elongated openings between them, said openings being parallel to the slats and extending the length of the deck and through the discharge end thereof;

a drive for imparting a screening motion to said frame;

said drive moving the deck in a horizontal rotary path wherein during the upstream half of the cycle said openings are moving transversely toward chips on adjacent slats facing the respective openings, and away from such chips during the downstream half;

the slat support means of adjacent slats being staggered with respect to one another, each slat being deflectable along its length between the slat support means which support it, adjacent slats thus being deflectable relative to one another along their entire length; and ball cleaning means having narrow, elongated ball support members which extend parallel to said slats.

2. The machine of claim 1 wherein said ball cleaning means includes balls captured in cages beneath the slats and supported on said ball support members, said ball support members being rods having spaced upstanding peaks formed along them which deflect said cleaning balls transversely toward said slats as the machine is operating.

3. The machine of claim 2 wherein the peaks on ball support members which are adjacent one another are in staggered positions along such members.

4. The machine of claim 2 wherein said cages having slanting walls which deflect said balls upwardly in operation.

5. The machine of claim 4 wherein said slat support means are mounted on top of said walls.

6. The machine of claim 1 further including drive speed control means for cyclically operating said drive at a predetermined rate for a predetermined interval, then increasing said rate to a higher rate for a shorter interval thereby to improve the clearing of chips caught in said openings, then again operating the drive at said predetermined rate.

7. The machine of claim 1 wherein said slats are flat bars spaced apart transversely sufficiently that they do not overlap one another in the vertical direction.

8. The machine of claim 1 wherein said slat support means are posts which are positioned so that the posts mounting a first slat are positioned between the longitudinal positions of the posts which mount adjacent slats on each side of said first slat.

9. The machine of claim 8 wherein each said post has a transverse dimension which is less than that of the corresponding slat, the posts not extending into said openings.

10. The machine of claim 9 wherein adjacent slats do not both have posts at the discharge ends thereof, such slats thereby being deflectable relative to one another at and adjacent said discharge end to release a chip if stuck between them.

11. The machine of claim 10 wherein each post has a base attached to the frame, an upstanding leg, and an angulated top arm secured to the corresponding slat.

12. The machine of claim 1 wherein said drive comprises an eccentric mounted to said frame and rotating in a horizontal plane.

13. The machine of claim 1 wherein said drive includes a rotatable eccentric which establishes a circular screening motion, and said frame is supported for longitudinal and transverse movement in response to rotation of said eccentric so that said screening motion acts uniformly over the entire area of said deck.

14. The machine of claim 13 wherein said frame is suspended.

15. The machine of claim 14 wherein said drive is mounted on said frame for movement with it.

16. A multideck machine for separating chips according to thickness, comprising, a frame mounting a plurality of inclined decks in stacked arrangement, each deck comprising a series of spaced parallel slats which are inclined downwardly from an upper feed end to a lower discharge end, said slats mounted on slat supports which are spaced apart along the length of the slats, said supports canting each slat transversely to the general plane of the deck, the slats presenting elongated openings between them;

frame support structure supporting said frame for screening motion;

feed means including feed dividing means for delivering approximately equal proportions of a feed stream onto the upper end of each deck, and collection means for collecting overs, accepts, and fines from each deck; and a drive for imparting a gyratory screening motion to said frame, said drive including at least one eccentric which rotates in a horizontal plane, said drive moving said deck in a horizontal circular path wherein during the upstream half of the path said openings are moving transversely toward chips on adjacent slats facing the respective openings, and away from such chips during the downstream half of the path.

17. The multideck machine of claim 16 further including ball cleaning means beneath each deck, said cleaning means having narrow elongated ball support members which extend parallel to said slats.

18. The multideck machine of claim 17 wherein said slats are sufficiently flexible between said slat supports to be vibrated by the ball cleaning means in operation, thereby to facilitate the release of chips stuck in said openings.

19. The multideck machine of claim 18 wherein said ball cleaning means includes ball support rods having projections at spaced intervals along their length which preferentially direct cleaning balls transversely against the slats.

20. The multideck machine of claim 19 wherein said projections are in the form of peaks formed at intervals along the length of the rods.

21. The multideck machine of claim 20 wherein the peaks on rods which are adjacent one another are in staggered positions along such rods.

22. The multideck machine of claim 21 wherein said ball cleaning means includes balls captured in cages beneath the slats of each deck, the balls supported in their cages on said ball support members, said cages having slanting walls which deflect said balls upwardly in operation.

23. The multideck machine of claim 22 wherein said slat supports are mounted on top of said walls.

24. The multideck machine of claim 16 wherein said slat supports are posts which are positioned so that the posts mounting a first slat are positioned between the longitudinal positions of the posts which mount adjacent slats on each side of said first slat.

25. The multideck machine of claim 16 further including a drive speed controller for normally operating said drive at a predetermined rate but periodically increasing said rate to a higher rate for a brief interval thereby to improve the cleaning of chips caught in said openings, then reducing the rate to said predetermined rate again.

26. The multideck machine of claim 25 wherein said drive speed controller controls said higher rate at about 10 to 25% higher than said predetermined rate.

27. The multideck machine of claim 16 wherein said drive includes an eccentric which establishes a circular screening motion, and said frame is supported for longitudinal and transverse movement relative to said frame support structure in response to rotation of said eccentric so that said motion is applied uniformly over the entire area of the deck.

28. The multideck machine of claim 27 wherein said frame is suspended from said frame support structure.

29. The multideck machine of claim 28 wherein said eccentric is mounted on said frame for movement with it.

* * * * *